United States Patent [19]

Nilsson

[11] 3,931,452

[45] Jan. 6, 1976

[54] DEVICE FOR ATTACHMENT OF CEILING-SUPENDED EQUIPMENT

[76] Inventor: Agne Lars Harry Nilsson, 430 60 Landvetter, Borgasvagen 20, Sweden

[22] Filed: Sept. 24, 1973

[21] Appl. No.: 400,400

[30] Foreign Application Priority Data

Sept. 26, 1972 Sweden ..... 12432/72

[52] U.S. Cl. ..... 174/48; 52/39; 248/343

[51] Int. Cl.[2] ..... H02G 3/26

[58] Field of Search ..... 174/48, 49; 240/1.4; 52/28, 39, 220, 221; 312/209; 128/1 R; 250/522, 523; 248/343

[56] References Cited

UNITED STATES PATENTS

| | | | |
|---|---|---|---|
| 3,094,584 | 6/1963 | Liberman et al. | 174/49 UX |
| 3,240,925 | 3/1966 | Paschke et al. | 240/1.4 |
| 3,246,074 | 4/1966 | Neumann et al. | 174/48 |
| 3,354,301 | 11/1967 | Bobrick | 174/48 |
| 3,692,920 | 9/1972 | Santarelli | 174/48 |
| 3,699,235 | 10/1972 | Wasson et al. | 174/48 |
| 3,762,398 | 10/1973 | Schefke et al. | 174/48 X |

*Primary Examiner*—J. V. Truhe
*Assistant Examiner*—David A. Tone

[57] ABSTRACT

A method and girder structure for attachment of ceiling-suspended equipment in operating theatres, X-ray- and examination rooms with joists and intermediate ceiling in hospitals, clinics and surgeries, a permanent load-carrying structure being attached to the ceiling of the room, a girder structure which is broad in relation to its height being attached to the joists, with its lower edge flush with the intermediate ceiling, said structure being provided with pipes and ducts for gases, fluids and exhaust in one channel and electric cables in another channel, an equipment for operating table lighting, anaesthesia, artificial ventilation, surgical distribution boards and X-ray equipment being displaceably secured to the girder structure which is also used for joint earthing of the ceiling-suspended equipment.

9 Claims, 5 Drawing Figures

DEVICE FOR ATTACHMENT OF CEILING-SUPENDED EQUIPMENT

Figure 1:
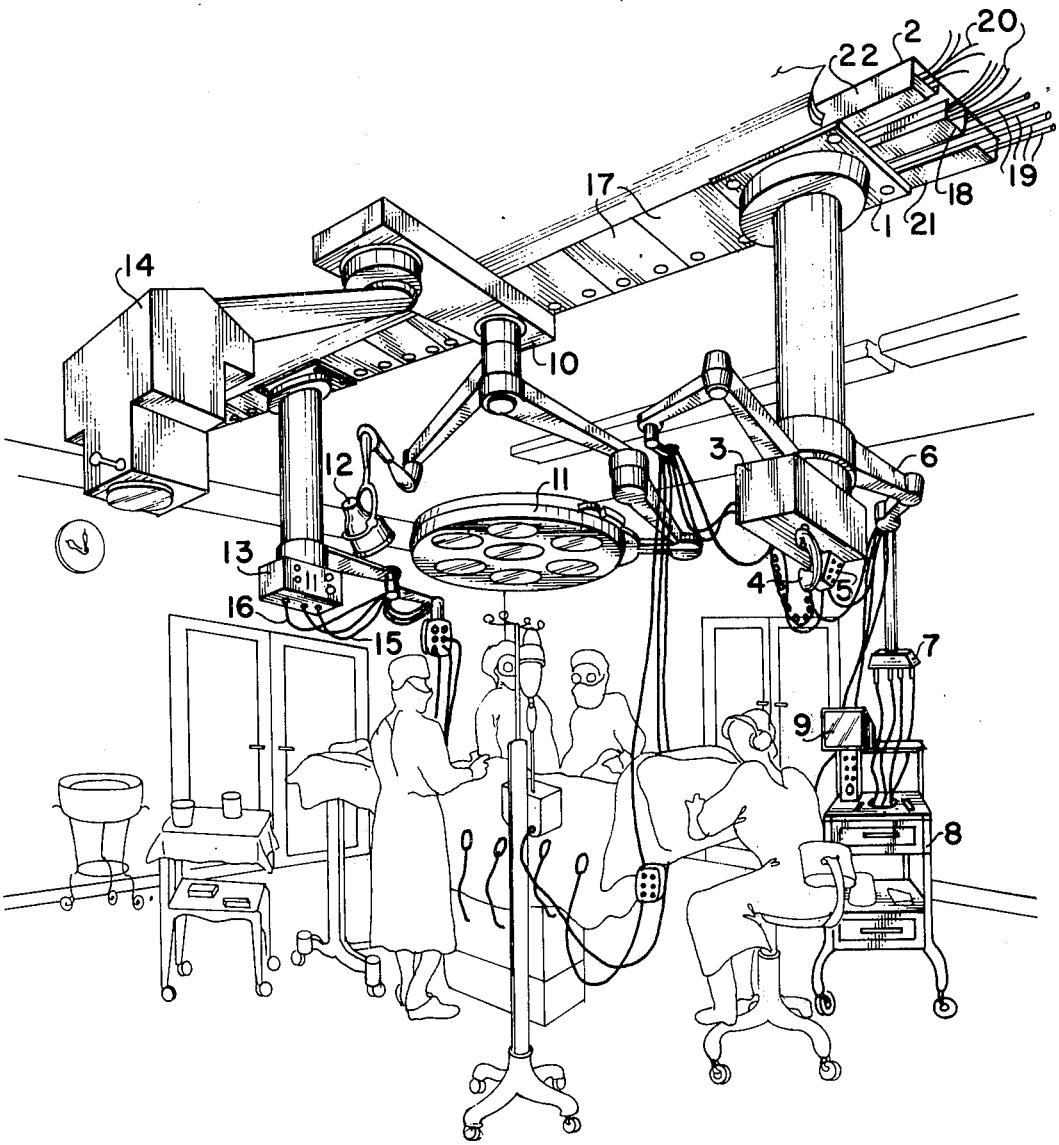

The invention relates to a method and device for attachment of ceiling-suspended equipment in operating theatres, X-ray rooms, examination rooms and similar premises with joists and intermediate ceiling in hospitals, clinics, surgeries etc.

The costs of planning of hospitals and operating theatres etc. are at present very high, among other reasons because of the large number of meetings — often 10 to 15 — and of investigations required before the final design can be decided upon in the form of drawings, specifications etc. to be delivered to the contractor. There is also the disadvantage that the plan is tied to the apparatus immediately available, or to certain products, and that it is not possible to take into account the further development which may take place during the period between planning and purchase. Another disadvantage is that after some time of use the design decided upon may prove unsuitable in certain respects and require minor and major adjustments in order better to suit the prevailing working conditions.

One object of the invention, accordingly, is to allow the implementation of proposed improvements and alterations of the selected equipment, and especially of its placing, after the planning stage and to some extent after purchase and even after some time of use.

It may prove necessary, for example, to increase the space on the anaesthetic side, so that the anaesthetic apparatus must be moved slightly away from the operating table. The so-called sterile zone, where the operation takes place, is predetermined by the ventilation conditions and is preferably situated in the part of the operating theatre furthest from the entrance. This means that the patient's head, and so the anaesthetic unit, is normally nearest to the entrance to the operating theatre. If it is desired that such an operating theatre shall be rearranged for, for example, ear or eye operations, the patient must be turned and the anaesthetic unit moved to the position previously occupied by the foot end of the table. Such alterations are at present either impossible or very difficult and costly to arrange. It is an object of the invention to eliminate this disadvantage as well.

Another aspect to be provided for through the invention in this context is patient safety. If, for example, a shortcircuit or flashover arises in equipment situated at the foot end of the operating table, this equipment may, despite earthing, assume a certain potential differing from the potential of the apparatus at the patient's head. There is then a risk that this potential difference may be equalized via the patient, whereby, for example, ventricular fibrillation may occur, which may result in a fatal outcome for the patient. It is an object of the invention to eliminate this risk as well.

Characteristic of the method according to the invention for attachment of ceiling-suspended equipment in operating theatres, X-ray rooms, examination rooms and similar premises with joists and intermediate ceiling in hospitals, clinics, surgeries etc., a permanent load-carrying structure being attached to the ceiling of the room, is that a girder structure which is broad in relation to its height is attached to the joists, preferably with its lower edge flush with the intermediate ceiling, that in the girder structure are arranged pipes and ducts for, for example, gases, fluids, exhaust etc. in one channel and electric cables in another channel, that to the girder structure are detachably or displaceably secured equipment or equipment distribution boards for operating table lighting, anaesthesia, artificial ventilation, surgical distribution boards, X-ray equipment etc., and that the girder structure is used for joint earthing of the celing-suspended equipment.

According to a preferred embodiment of the invention it is proposed, furthermore, that the attachment of the equipment to the girder structure is effected by clamping of anchor plates and/or clamps secured to the upper part of the equipment. Cover plates or the like are preferentially placed between these anchor plates to cover open parts of the underside of the girder structure.

It is also proposed according to the invention that the equipment be terminated by means of flexible hoses, cables or other leads which connect the equipment to the fixed ducts, so permitting movement or repositioning of equipment along the girder structure over a wide area.

It has also proved advisable to attach the equipment units with clamps which, even when not tightened, reliably support the associated unit but allow it to be moved longitudinally in the girder structure.

To implement the procedure according to the invention, furthermore, a girder structure is proposed for permanent attachment to the joists of the room, characterized in that it consists of at least one, preferably two, longitudinal girders with lower flanges which permit attachment of ceilingsuspended equipment, that in and/or between the girders ducts for gases, liquids and exhaust and electric cabling can be installed, and that the girder structure is made chiefly of electrically conductive material.

In such a girder structure with one longitudinal girder the girder according to the invention is advantageously made as a box girder open on its lower side, preferably of heavy steel plate, with a longitudinal partition at or near its centre. If, on the other hand, the girder structure is composed of two longitudinal girders, the longitudinal partition should be arranged between the girders. In the case of three girders the central girder serves also as partition. In all cases, according to the invention, on one side of the partition there is a channel with pipes for anaesthetic gas, oxygen, air, compressed air, water, exhaust etc., and on the other side of the partition another channel with cables for telecommunication, signal current, low voltage current, power current, high voltage etc. The partition forms two separate channels in the girder, one for gases and one for electric cables. There should preferably be a seal between these two channels. This has an additional advantage from the point of view of fire protection, as in the event of a leakage of gas and electric flashover the flashover cannot ignite the gas. Furthermore the channel space forms part of the room, so that flexible plastic hoses and leads and terminations can be permitted in the channel space.

According to the invention the ducts and cables are furnished with terminations or means of termination for flexible hoses and leads to the ceiling-suspended equipment or equipment components. It is also proposed according to one embodiment that there should be a seal of in itself known kind between the channels on the two sides of the partition. The girder structure should preferably be furnished with sealing devices and/or agents to provide a seal with the intermediate ceiling and the space above it.

A preferred embodiment according to the invention is characterized in that it has a torsion-resistant profile and devices for torsion-resistant attachment to the joists to allow take-up of torque around the longitudinal axis of the girder structure and thereby also lateral mounting of ceilingsuspended equipment with full security.

According to a further development of the invention the girder structure is preferably closed at the top and along the sides, while its underside is chiefly open in order at least partially to be covered with cover plates fittable from below between the anchor plates for the ceiling-suspended equipment. For installation, inspection, servicing etc. of ducts and cables in the girder structure these cover plates are fittable so as to be easily removable by means of quick coupling devices of suitable conventional design. In this way all connections to the fixed installation can easily be made from below and at a single point. The quick couplings in the cover plates further facilitate this work. The critical connection points which earlier existed owing to the lack of space between equipment and ceiling are also avoided. The erection of the heavy ceiling-suspended units is facilitated by the fact that the girders are open below and by an ingenious attachment of the assembly plates for the ceiling-suspended equipment.

The invention will now be described with reference to the examples of embodiments shown in the attached drawings, but without limiting the invention thereto. These show more or less schematically, FIG. 1 an operating theatre with operation in progress, in the ceiling of which there is a girder structure according to the invention, on the right shown partially in cross-section, FIG. 2 a vertical section through a girder structure according to the invention flush with an intermediate ceiling but without ducts inserted, FIG. 3 the ingenious attachment of the equipment to the girder structure by clamping of anchor plates and clamps fitted to the upper part of the equipment, FIG. 4 a part of the girder structure covered with cover plates, a cover plate with quick coupling being shown in open position, FIG. 5 from below a joist for a future operating theatre with girder structure according to the invention secured in the joist, without ducts or ceilingsuspended equipment.

On the right in FIG. 1 is the anaesthetic unit, consisting of a terminal box 3 and an anaesthetic distribution board 7 from which the anaesthetist performs anaesthesia of the patient. The ceiling attachment 1 of the anaesthetic unit is secured by four clamps to the girder structure 2 consisting of two longitudinal girders 21, 22. A non-loudspeaking intercom telephone 4 suspended in the terminal box 3 permits outward communication without disturbance of the patient or the operating team. A setting mechanism 5 permits the operating table to be set to different positions. From the overhead support of the anaesthetic distribution board there projects sideways on arm 6 with an anaesthetic distribution board 7 and an additional arm 6*a*. This anaesthetic distribution board 7 has in the present case four terminations, for example for oxygen, laughing gas, air and vacuum for evacuation of surplus gases. The anaesthetic table 8 with castors is connected via hoses to this anaesthetic distribution board 7. On the anaesthetic table 8 there is also a cardioscope 9, connected to the terminal box 3, which continuously shows the patient's heart activity. Blood heater, drip apparatus, cables for electromedical purposes and possibly cables for recorders in adjoining rooms, etc., can also be connected to the terminal box 3.

Apart from the anaesthetic unit a ceiling-suspended operation lighting device 10 is also fitted to the girder structure 2 which is recessed in the ceiling and the lower edge of which in the present case is roughly on a level with the intermediate ceiling of the operating theatre. The device 10 has a tiltable and swivelling main lamp 11 and a satellite lamp 12. The remaining room lighting is provided by conventional fittings, e.g. fluorescent lamps.

At the girder structure 2 there is a lateral girder which carries the aforesaid operation lighting and also a laterally fitted X-ray apparatus 14. Owing to its positioning aside from the girder structure 2 the lateral girder can be swung over the patient for X-ray examination and be swung out of the way sufficiently far to avoid being an obstruction when not in use. The girder structure 2 according to the invention can without difficulty be of standard form and be attached with such torsional resistance that it withstands such a torsional load without being appreciably deformed.

The so-called surgical distribution board 13 is secured to the girder structure 2 roughly over the foot end of the operating table. Like the anaesthetic distribution board the surgical distribution board has a laterally projecting arm which in FIG. 1 is slightly obscured by the main lamp 11 and its suspension. The surgical distribution board 13 contains a number of sockets, terminals, switches and quick couplings, for example a hose or cable to an operation suction device, terminal 15 for diathermy, socket 16 for compressed air for pneumatic operation tools, source of light for fibre optics, terminal for centrally supplied cryogenic apparatus for freezing in conjunction, for example, with eye operations, the low temperature being produced by expansion of compressed $CO_2$, etc.

Between and outside the attachments of the ceiling-suspended devices there are cover plates 17 to cover the girder structure and its ducts.

The girder structure 2 proposed according to the invention consists, in the embodiment in FIG. 1, of two longitudinal channels 21, 22, the upper flanges of which are secured in the concrete ceiling and the lower flanges of which permit attachment of the ceiling-suspended equipment. Between the girders is a partition 18 on its right and left are pipes 19 for, for example, respiration, compressed air, oxygen, laughing gas, water, and exhaust, and electric cables 20 for communication, low tension current, power current, high voltage, and signal current.

Figure 2:
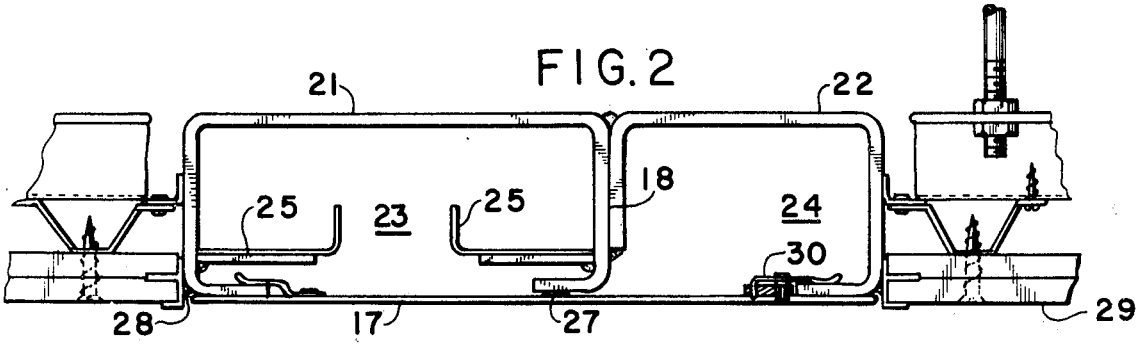

FIG. 2 shows an alternative embodiment of the proposed girder structure with two box girders 21, 22 which together are fairly wide in relation to their height — the width is about 4 times the height — and are welded together along their adjacent sides to form a single box girder. The said sides form the partition 18 with two separate channels 23 and 24 on its left and right respectively. Channel 23 on the left, for example, can form the electric cable duct with two rows of brackets 25, of which one may suitably be used for high voltage cable and the other for low voltage cable. Channel 24 on the right of the partition 18 can then suitably be used as gas duct. For use in X-ray laboratories, for example, no gas pipes are required and signal cables can then be laid in channel 24, so effectively preventing induction of currents from high voltage cables into said signal cables. The girder then serves at the same time as earthed screen.

From FIG. 2 it is also seen that hygienically the girder structure forms a unit with the intermediate ceiling 29, since ceiling and girder structures are well sealed to one another by means of seals 28. The electric cable channel 23 and gas channel 24 are also sealed to one another by a longitudinal sealing strip 27 applied along the underside of the partition 18.

Figure 3:
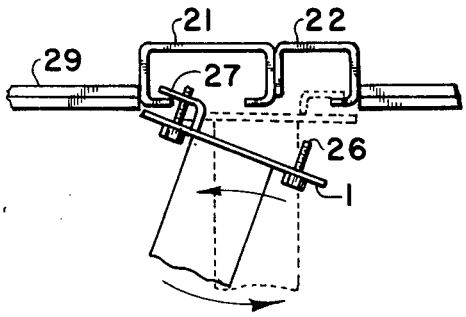

The suspension of the equipment by means of the ingenious attachment, shown in FIG. 3 of the assembly plates in the girder structure greatly facilitates the erection of the heavy ceiling-suspended units and in the present case is conceived of in the form of anchor plates 1 through which screws 26 extend and which, instead of nuts, engage with non-turnable clamps 27 with threaded holes so that, after releasing of the screws 26 the suspended equipment can be moved in the longitudinal direction of the girder structure. Of course the equipment can also be entirely released and, for example, the surgical distribution board and anaesthetic distribution board can change places or be moved to other rooms.

Figure 4:
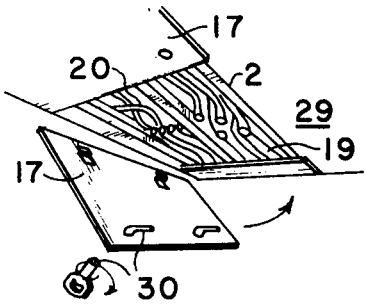

The connection of the equipment to fixed pipes and cables in the girder structure is done via flexible hoses and cables so that no reconnection is required for movement or adjustment of the position of the equipment. Only the length of the cover plates 17 must be adjusted to altered distances between the equipment anchor plates and between them and the ends of the girder structure. The cover plates can be chosen in modular lengths; for erection of ceiling-suspended equipment the cover plates can advantageously be replaced by assembly plates in the same module. The work is further facilitated by providing the cover plates with quick couplings 30 of conventional type, as shown in FIG. 4, which also facilitates inspection and servicing of cables.

Figure 5:
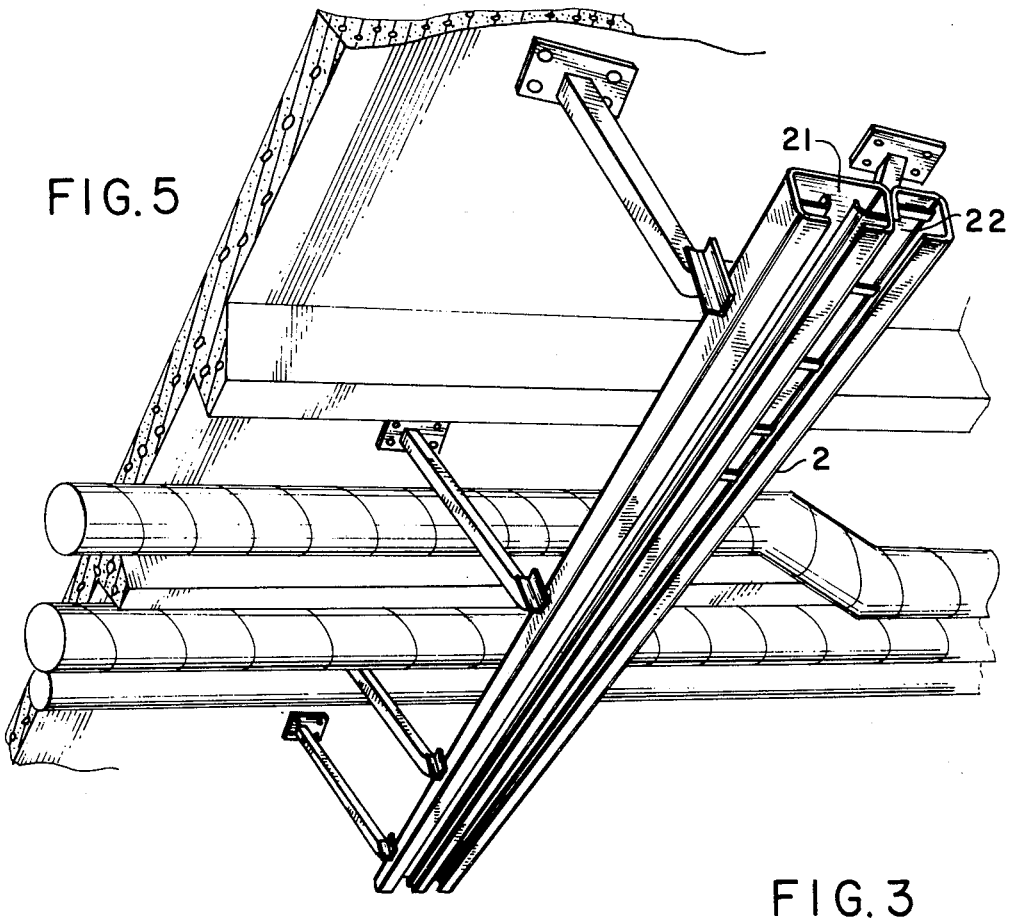

As appears from FIG. 5, the erection of the girder is unaffected by downward projecting girders in the joists. The girder structure according to the invention can accordingly be arbitrarily arranged in the longitudinal or transverse direction of the room or, of course, diagonally or at any other angle, which further assists in the planning work. For instance the most advantageous placing can be fairly freely decided upon on the basis of the available space, the volume of the equipment and the intended technique. The girder structure should preferably be placed flush with the intermediate ceiling or, if there is no intermediate ceiling, surface-mounted directly on the joists. If the girder is placed flush with the intermediate ceiling, the ceiling height of the room will be unchanged.

Also for modernization of old hospitals the use of the girder structure according to the invention in the reconstruction is very rational and saves costs. It reduces all earlier troublesome recessing of electric cable and gas ducts, terminal boxes, fixtures etc. and permits the connection of equipment to a fixed installation at a single point. The connecting point can be located, for example, in the corridor outside the room by erecting the girder against the ceiling and drawing it through the wall between the two spaces. Equipment ceiling-mounted by means of the girder structure in, for example, old modernized buildings can extremely easily be transferred to a new building, so saving much time and considerable costs.

Since the girder structure is made of electrically conductive material, preferentially steel or steel plate, and the described equipment is screwed or clamped to it, the covers of all connected components can always be made to lie at the same electric potential. Thus no potential differences can arise between different components connected to the patient, so that the patient is effectively protected against the passage of electric currents which may otherwise arise as a result of different earth potentials in different components, especially in the case of short-circuit, electric flashover or electrostatic charging of equipment or cables.

What is claimed is:

1. A load-carrying structure adapted for attachment to ceiling joists of a medical facility and comprising an elongate girder whose width is larger in dimension than its height and having at least two separate, isolated channels in its width direction, one of said channels accommodating electric cables and the other channel accommodating piping for supply of fluid therethrough, and means for carrying equipment connected at predetermined locations to said girder and being detachable from and displaceable with respect to said predetermined location to thereby permit greater latitude in positioning of equipment carried by said means, said girder structure being of electrically conductive material and constituting a common electrical earth connection for equipment effectively supported thereby.

2. Structure according to claim 1, wherein said means for carrying equipment comprises an anchor plate connectable to lower walls in part defining said two channels.

3. Structure according to claim 2, wherein said anchor plate is attached to said girder by clamps, which when untightened, enable equipment on the plate to be moved relative to said girder.

4. Structure according to claim 1, wherein a plurality of anchor plates are connected in spaced apart relation to one another, to said girder, cover plates being provided for connection to said girder and locations thereof between said anchor plates.

5. Structure according to claim 4, wherein said girder has continuous upper and bounding side surfaces which terminate in inwardly projecting, spaced apart, flanges which serve as connecting means for said anchor and cover plates.

6. Structure according to claim 1, wherein equipment carried by said means has at least one flexible cable to enable connection of said equipment to fixed fluid or electrical supply means in the channels of said girder whereby to permit repositioning of equipment relative to said fixed means along the girder.

7. Structure according to claim 1, wherein said girder is a box girder which is opened at its lower side and having said two channels separated by a longitudinally extending partition.

8. Structure according to claim 7, wherein sealing means provide a seal between said channels.

9. Structure according to claim 8, having a torsion resistant profile to permit laterally offset mounting of equipment from said girder with respect to the longitudinal axis thereof.

* * * * *